United States Patent [19]

Kolt

[11] Patent Number: 4,591,092

[45] Date of Patent: May 27, 1986

[54] ENERGY SAVER DAMPER ASSEMBLY

[75] Inventor: Stanley Kolt, Mamaroneck, N.Y.

[73] Assignee: Leonard W. Suroff, Jericho, N.Y. ; a part interest

[21] Appl. No.: 710,965

[22] Filed: Mar. 12, 1985

Related U.S. Application Data

[62] Division of Ser. No. 505,789, Jun. 20, 1983, Pat. No. 4,520,959.

[51] Int. Cl.[4] ..... F24F 13/10

[52] U.S. Cl. ..... 236/49; 98/32; 236/92 C

[58] Field of Search ..... 236/49, 92 R, 92 C; 98/102, 106, 32; 251/285

[56] References Cited

U.S. PATENT DOCUMENTS

| | | | |
|---|---|---|---|
| 1,155,525 | 10/1915 | Spencer | 251/285 X |
| 3,027,090 | 3/1962 | Zerhan, Jr. | 98/85 X |
| 3,082,678 | 3/1963 | Wolley et al. | 98/106 |
| 3,436,016 | 4/1969 | Edwards | 236/49 |
| 4,038,911 | 8/1977 | Hart | 49/52 X |
| 4,210,277 | 7/1980 | Kolt | 98/86 X |

*Primary Examiner*—William E. Tapolcai

*Attorney, Agent, or Firm*—Leonard W. Suroff

[57] ABSTRACT

An energy saver automatic temperature responsive vent, for permitting the passage of air from one defined space to another, which includes a frame for mounting over an opening extending from one defined space to another defined space, the frame having a central passage disposed therethrough and a flap movably mounted to the frame, so as to be means, movable from a closed portion substantially blocking the passage to an open portion permitting the flow air therethrough, a temperature drive assembly being provided to open and close the flap in response to changes in temperature. Adjustment means are provided to preclude the flap from closing entirely, if desired. In addition, the vent is configured so that it has a recess disposed therein for accommodating the knob or the like of an adjustment means on a similar vent so that the vents can be nestled together in the most compact space possible as an expedient to shipping.

10 Claims, 9 Drawing Figures

FIG. 3
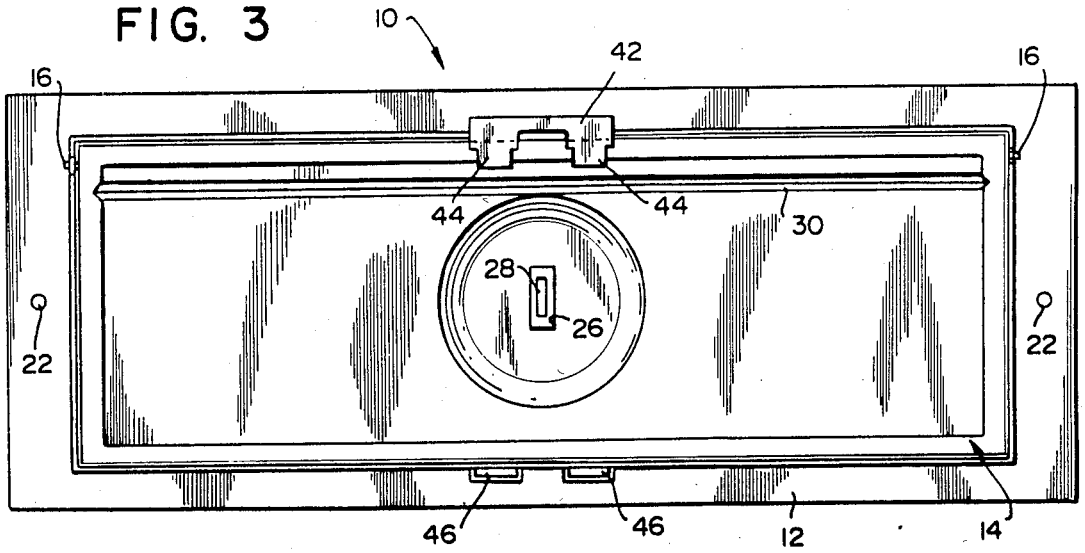
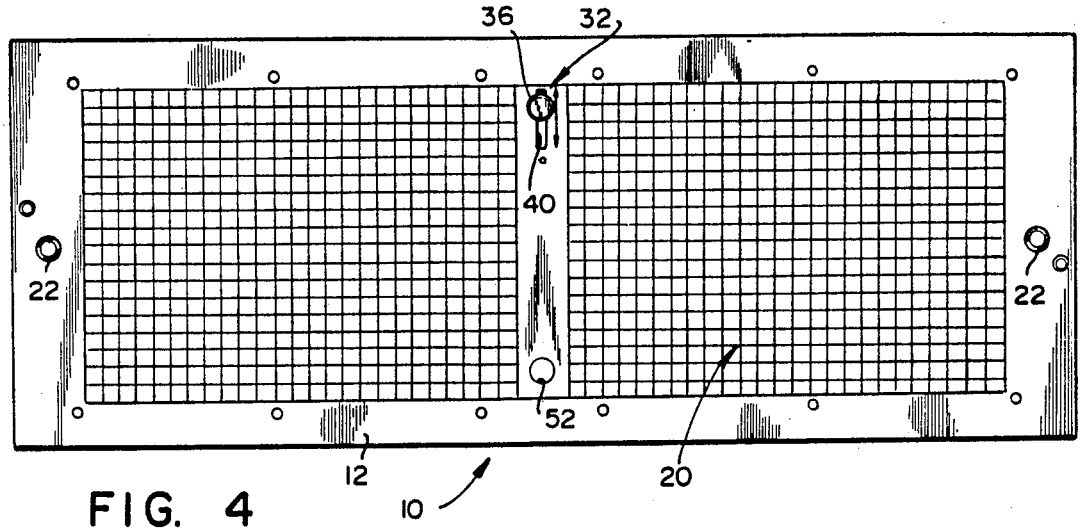
FIG. 4
FIG. 5
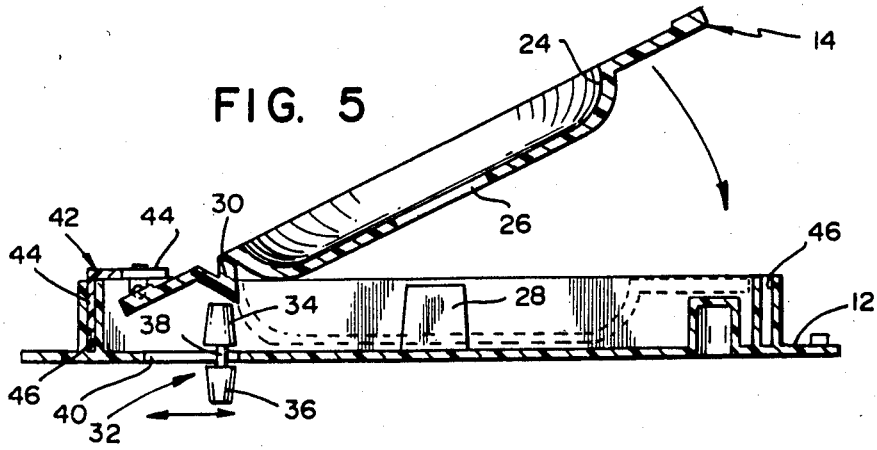

FIG. 6
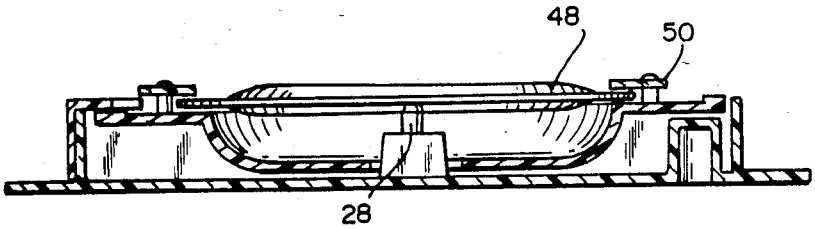
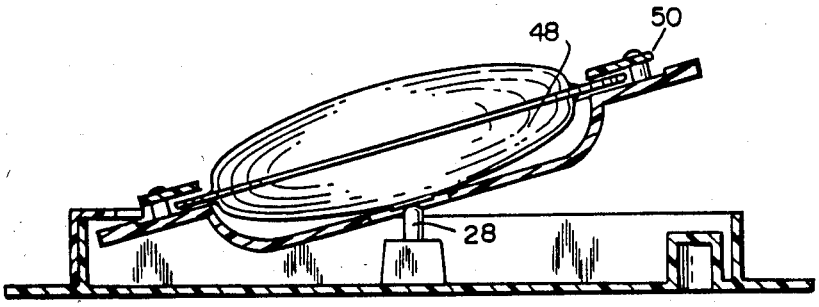
FIG. 7
FIG. 8
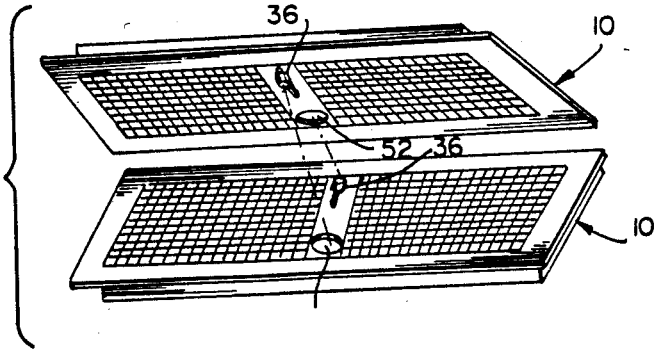
FIG. 9
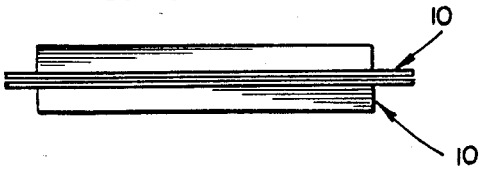

ENERGY SAVER DAMPER ASSEMBLY

This application is a divisional application of parent application Ser. No. 505,789, filed on June 20, 1983, now U.S. Pat. No. 4,520,959.

BACKGROUND OF THE INVENTION

1. Field of the Invention

The present invention is directed generally to automatic temperature responsive vents for use in permitting the passage of air from one defined space to another such as between an attic space through the ceiling of the room. More specifically, the present invention is directed to such an automatic vent which is temperature responsive so that its opening is automatic and which can be adjusted as to the minimum opening provided.

2. Description of the Prior Art and/or Contemporary Art

It is frequently desirable to permit the venting of air from a room space into an attic which is in itself vented to the outside atmosphere. As a result of such an arrangement, when the attic is vented through active or passive means, the rooms which employ such automatic vents can also be similarly vented. For example, cool air can be permitted to enter the rooms and simultaneously, warmer air with contaminants, odoriferous aromas and moisture can be caused to rise to the ceilings of the room and through automatic vents mounted on the ceilings into the attic space so that they can be vented from the attic space out of the building. Ventilators which are employed to vent from attic areas or the like through roofs to the atmosphere are known in the art. Such devices include those shown in U.S. Pat. Nos. 4,123,001 and 4,210,277 invented by the inventor of the subject invention. Additionally, such a roof ventilator is shown in U.S. patent application Ser. No. 500,074 also by the same inventor as the present invention.

Other ventilators are also shown in U.S. Pat. Nos. 1,737,054; 3,921,900; and 3,976,245.

Unfortunately, for various reasons, including their large size and complexity, none of the presently known automatic vents are entirely suitable for mounting on the ceilings of rooms to vent into an attic. Furthermore, these vents are primarily designed to be installed from the area where the venting is to take place to rather than from where the venting is to take place from. These vents would therefore have to be installed from an attic area, which is rather inconvenient, as compared to installation from within the room which is to be vented.

A simplified and compact construction is also desirable since this almost necessarily dictates a reduction in cost, a necessity since in order to be employed most effectively, room to attic type ventilators must be installed in every room of a dwelling which has a ceiling bounded by attic space. Another disadvantage of prior art automatic ventilators is that they can not be easily and compactly packed for transportation and delivery, therefore still further increasing the cost associated with procurement.

An additional disadvantage of prior art devices is that they are in an entirely closed position when the temperature responsive mechanisms thereof reach a set temperature or temperature therebelow. Depending on circumstances, there are instances when an entire blockage of the flow of air is not desirable and it is instead desirable to permit minimal air flow regardless of the temperature of the air adjacent to the vent. Means for accomplishing this are not shown or suggested in automatic vents known in the prior art.

The present invention overcomes the shortcomings associated with the prior art by providing an automatic temperature responsive vent for permitting the passage of air from one defined space to another which includes adjustment means that permits the desired flow of air even when the vent is essentially in a "closed" position in respect to the operation of the temperature responsive means thereof. In addition, the present invention comprises an automatic temperature responsive vent which is extremely compact in installation and which can be installed in a ceiling opening from the room side of such opening with minimal effort and expense. Furthermore, the present invention provides an automatic vent which is configured for compact shipping to further cut costs associated with installation.

OBJECTS OF THE INVENTION

An object of the present invention is to provide an automatic damper assembly for use in ventilating systems wherein rooms are to be vented into attics or other similarly defined spaces are to be vented into adjacent spaces.

Another object of the present invention is to provide an automatic damper which requires no attention and which achieves its venting function without human intervention.

A further object of the present invention is to provide an automatic temperature responsive vent which is activated automatically in response to a preselected change in temperature.

A further object of the present invention is to provide an automatic temperature responsive vent which can be adjusted so that a minimal air flow can be accomplished even when the vent is in a substantially closed position in respect to the temperature responsive means thereof.

Still another further object of the present invention is to provide an automatic temperature responsive vent which employs essentially no moving parts except for the damper flap thereof, thereby minimizing the cost of manufacture.

An additional object of the present invention is to provide an automatic temperature responsive vent which is configured such that a pair of such vents can be nestled together to permit compact shipping.

A still additional object of the present invention is to provide an automatic temperature responsive vent which can be used in conjunction with attic-type ventilators to provide an integrated house ventilation system.

Still another additional object of the present invention is to provide an automatic temperature responsive vent which is simple in design, inexpensive to manufacture, rugged in construction and efficient in operation.

Other objects and advantages of the present invention will become apparent as the disclosure proceeds.

SUMMARY OF THE INVENTION

An automatic temperature responsive vent for permitting the passage of air from one defined space to another is provided for installations such as in the ceiling of rooms of a house wherein the rooms are vented into an attic area which is itself vented to the outside atmosphere. The damper or flap of the vent is opened by a temperature responsive drive assembly which, in response to a preselected temperature, causes such opening. In addition, adjustment means are provided which are coupled to the flap of the invention, to preclude the flap from assuming an entirely closed position so that ventilation can take place to a preselected degree even when the temperature responsive assembly of the automatic vent is not activated to cause opening of the flap.

The above functions are structurally provided by a frame means which is configured for mounting adjacent to an opening from one defined space to another defined space, such a hole cut in a ceiling, the frame means having a central passage disposed therethrough. Flap means is movably mounted to the frame, preferably by suitable pivot arrangement, such that the flap means is movable from a closed position substantially blocking the passage in the frame to an open position permitting the free flow of air therethrough, the flap means assuming the closed position when at rest due to the effect of gravity. A temperature responsive drive assembly means is mounted to detect temperature changes adjacent to the opening and when activated, the drive assembly means moves the flap means from the rest position to an open position in proportion to the temperature change sensed by the temperature responsive means. Adjustment means in the form of a movable wedge which acts upon the flap means, in between the flap means and the frame means, is provided to preclude the flap from assuming a closed position when at rest, thereby providing some degree of ventilation.

To accomplish a compact configuration which is inexpensive to manufacture, the temperature responsive drive assembly means of the vent is mounted between a portion of the frame means and a portion of the flap means, the temperature responsive drive assembly means being actuated in response to temperature changes within a predetermined range. Upon actuation the temperature responsive drive assembly means expands and this expansion results in displacement of the flap means relative of the frame means. More specifically, the flap means provides a depression in which the temperature responsive means is mounted and the frame includes a protrusion which is extensible through an aperture disposed in the depression. When the temperature responsive drive assembly means expands, it exerts a force on the protrusion and causes shifting of the flap means relative to the frame.

The temperature responsive drive assembly means preferably includes a temperature-sensitive bellows power unit which essentially is an expansible metal casing that includes a gas disposed therein which expands when it reaches a selected temperature.

BRIEF DESCRIPTION OF THE DRAWINGS

Although the characteristic features of this invention will be particularly pointed out in the claims, the invention itself, and the manner in which it may be made and used may be better understood by referring to the following description taken in connection with the accompanying drawings forming a part hereof, wherein like reference numerals refer to like parts throughout the several views and in which:

FIG. 3 is a top plan view of the vent of FIG. 2;

FIG. 4 is a bottom plan view of the vent of the present invention;

FIG. 5 is a cross-sectional view taken substantially along the lines 5—5 of FIG. 2;

FIG. 6 is a cross-sectional view of the temperature responsive means of the present invention in a closed position;

FIG. 7 is a cross-sectional view of the temperature responsive means of the present invention in an open position;

FIG. 8 is a pictorial representation of a pair of vents incorporating the principles of the present invention prior to nestling and showing the nestling feature thereof; and FIG. 9 is a side view of the vents of FIG. 8 in a nestled position.

DESCRIPTION OF THE PREFERRED EMBODIMENT

Figure 1:
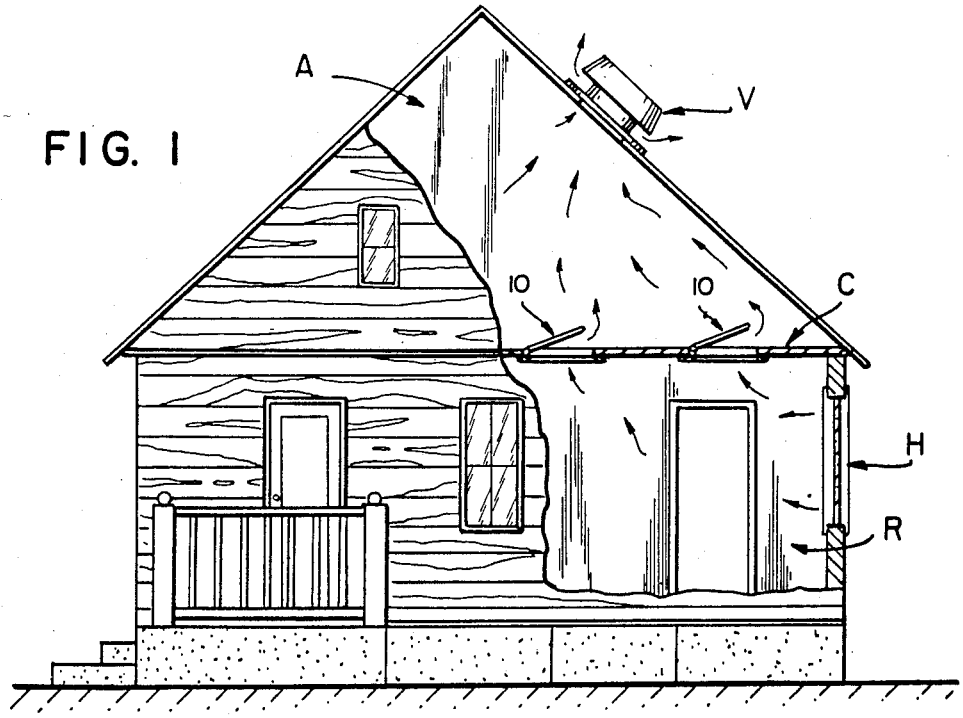
FIG. 1 is a partially broken-away side elevation of a house in which a plurality of automatic vents constructed in accordance with the principle of the present invention are installed.

Referring now to the Figures and more particularly, to FIG. 1 thereof, there is illustrated therein a house H having an attic A and a room R adjacent to the attic A. An automatic roof ventilator V is installed in the roof of the house H and vents the attic A to the outside atmosphere. A pair of energy saving automatic temperature responsive vents 10 are installed in the ceiling C of the house H above the room R and serve to vent the room R into the attic A. The construction of the vents 10 will be hereinafter described in conjunction with FIGS. 2 through 9. The vents 10 are each constructed so that they open upon the air adjacent thereto reaching a certain selected temperature and, as is illustrated by the arrows in FIG. 1, can be employed to permit fresh air to enter the room R and stale air to be exhausted into the attic A where it is then vented to the outside atmosphere through the vent V. Depending on the adjustment of the automatic temperature responsive vents 10, they can be entirely closed when a preselected temperature is not reached or can be opened a desired degree to permit ventilation even if the preselected temperature has not been reached. In a typical installation, one automatic temperature responsive vent 10 would be placed in the ceiling of each room adjacent to an attic so that each room would have an equal opportunity to have the contaminated and/or undesirable air vent therefrom through the attic to the outside atmosphere.

Figure 2:
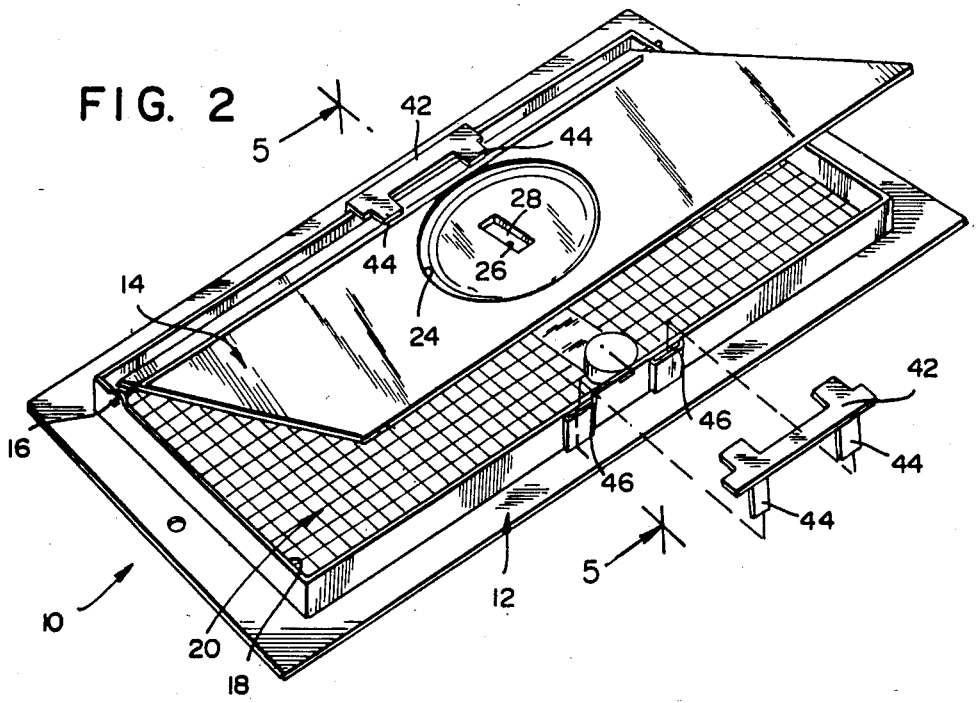
FIG. 2 is a partially-exploded top view in perspective of an automatic temperature responsive vent incorporating the principles of the present invention therein.

With reference to FIGS. 2 through 4, the vent 10 is seen to include a frame 12 and a flap 14. The flap 14 is pivotally affixed to the frame 12 by a pair of pivot rods 16 that are integrally formed with the flap 14 and which journal in apertures disposed in the frame 17 in a conventional manner. The frame 12 has a central passage 18 disposed therethrough which is selectively blocked by the flap 14 depending upon its position relative to the frame 12 as it pivots on the pivot rods 16. The frame 12 has the central passage 18 thereof covered by a grille 20 to form an exposed appearance, as shown in FIG. 4, which is similar to that of conventional vents or registers. Of course, although the grille 20 is shown in a particular pattern and configuration, it is to be understood that those of ordinary skill in the pattern and art could modify this configuration as desired.

In order to minimize costs of manufacture, the frame 12 and flap 14 are preferably constructed of plastic, a material well-suited for such an application. The pivot rods the flap 14 or instead, can take the form of integrally-formed protrusions which are molded with the flap 14 as noted above or can be formed by a rod which extends through the flap 14. The edges of the flap 14 include a plurality of mounting apertures 22 for securing the frame 12 to a supporting surface such as ceiling C of FIG. 1. When mounted, the grille 20, as shown best in FIG. 4, forms the portion of the automatic responsive vent 10 which is exposed, the unexposed surfaces of the vent 10 being shown in FIG. 3. The flap 14 has a central depression 24 disposed therein for accommodating a temperature responsive device which will be hereinafter described. Located in the central depression 24 is an aperture 26 which extends through the flap 14. The aperture 26 is dimensioned to accommodate therethrough a protrusion 28 which is formed or alternately mounted on the frame 12 via the grill 20 thereof.

With specific reference to FIG. 5, the manner in which the protrusion 28 extends through the aperture 26 can be viewed with the flap 14 being illustrated in an open position and also being shown in phantom in a closed position wherein the protrusion 28 extends through the aperture 26. With further reference to FIG. 5, that the flap 14 is molded with a substantially V-shaped ridge 30 which extends the length of the flap as can be further seen by the back indentation of the ridge 30 in FIG. 3. The ridge 30 is provided for interaction with an adjustment slide 32. The adjustment slide 32 comprises an inner button 34 and an outer button 36 joined by a shaft 38. The shaft 38 is freely slidably in a slot 40 disposed in the grille 20 of the frame 12 as shown in FIG. 5. The surface of the grille 20, adjacent to the button 34 about the aperture 40, is roughened so as to induce friction between the button 34 and the grill 20 to preclude sliding of the button without user intervention. The substantially V-shaped ridge 30 acts as an incline against which the button 34 interacts and, depending upon the placement of the shaft 38 within the slot 40, the degree that the flap is permitted to close can be varied. As illustrated in FIG. 5, when the adjustment slide 32 is at the right hand right side of the slot 40, the flap 20 is kept in an open position. As the adjustment slide 32 is moved in the slot 40 toward the right side of the drawing, the amount the flap is kept open decreases until the incline of the substantially V-shaped ridge 30 is no longer contacted and the flap 14 can entirely close the central passage 18 of the frame 12.

The interaction of the adjustment slide 32 and the substantially V-shaped ridge 30 provides an inexpensive yet effective means of adjusting the degree to which the flap 14 will close. Of course, other suitable means for adjusting the degree of closure of the flap 14 can be employed within the spirit and scope of the invention. Depending upon the particular plastic used to mold the flap 14, flexure thereof may occur where the substantially V-shaped ridge 30 is forced, by gravity, against the adjustment slide 32. To preclude this, a brace 42 as illustrated in FIGS. 2, 3 and 5 is provided. The brace 42 includes a pair of arms 44 which extend over the edge of the flap 14 to preclude flexing. The brace 42 also includes a pair of legs 44 which slide into mating receptacles 46 formed in the frame 12. When the legs 44 of the brace 42 are inserted in the receptacles 46, they are secured in position by a suitable cement or the like. A second brace 42 is supplied with the vent 10 and may be inserted and frictionally secured in a second pair of receptacles 46. The second brace 42 is supplied as a shipping expedient and acts as a temporary means for securing the flap 14 in position. When the automatic temperature responsive vent 10 arrives at its point of use, the second brace 42, illustrated in a removed position in FIG. 2, is removed and discarded.

The flap 14 is moved from its rest position, caused by gravity, as illustrated in FIG. 5 to an open position through the action of a differential force between the flap 14 and the protrusion 28 of the frame 12.

This differential force is generated by a heat responsive sealed bellows power drive unit shown in FIGS. 6 and 7 in position in the depression 24 of the flap 14. The heat responsive sealed bellows power drive unit 48 serves as a thermal power source which causes the opening of the flap 14 upon the expansion thereof. The power drive unit 48 is of a conventional design and is filled with a heat expansible fluid, the volatility of which is matched along with the shell thickness, the type of metal, and volume of the unit to provide a suitable expansion at the desired temperature range. In addition to being actuated at the appropriate design selected temperature range (80° F. to 160° F.), the power drive unit 48 of the present invention is also capable of generating a force of sufficient magnitude per square inch in order to be operable to move the flap 14 relative to the frame 12. It will be understood that any number of temperature sensitive power drive units may be utilized to perform this function so long as their expansion and contraction characteristics are predictable and the force generated is suitable over the desired temperature range.

The heat responsive sealed bellows power drive unit 48 is secured in position within the central depression 24 of the flap 14 by a strap 50 fixedly secured on the ends thereof to the flap 14. The strap 50 confines the power drive unit 48 within the central depression 24 as illustrated in FIG. 6. When the flap 14 is in a substantially closed position as illustrated in FIG. 6, the heat responsive sealed bellows power drive unit 48 assumes its minimum height. Upon being subjected to a temperature within its activation range, the power drive unit 48 expands, as illustrated in FIG. 7, exerting a force on the protrusion 28 of the grille 20 of the frame 12, thus causing opening of the flap 14 as illustrated in FIG. 7. When the power drive unit 48 is again subjected to a temperature outside its activation range, the power drive unit decreases in height and the flap 14 is closed a proportional distance. Through use of the depression 24 and the protrusion 28 cooperating with the aperture 26, the force of the power drive unit 48 is effectively exploited without necessity for any type of mechanical coupling or linkage between the power drive unit 48 and the flap 14.

Although the power drive unit 48 is shown to be fixedly secure to the flap 14 and the protrusion is provided by the grille 20, it is to be understood that the power drive unit 48 could alternately be fixedly secured to the frame 12 and especially the grille 20 thereof and the protrusion could be provided on the flap 14 to achieve the same result within the principles and scope of the subject invention. Similarly, it is to be understood that means other than the strap 50 could be employed to fix the power drive unit 48 in place. As another alternative, the heat responsive sealed bellows power drive unit 48 could be replaced with a bi-metallic thermostat in lieu of the gaseous thermostat disclosed, this variation also being within the scope of the invention.

In order to facilitate shipping so that the substantially planar surfaces of the grilles 20 can be placed adjacently on two automatic temperature responsive vents 10 an aperture 52 is disposed in the face of each such vent 10 as illustrated in FIGS. 4 and 8. The apertures 52 are sized to accommodate the buttons 36 of an adjacent vent 10 when they are placed in a close overlying relationship as illustrated in FIG. 9. This permits shipment of pairs of automatic temperature responsive vents in the minimum possible space and at the same time protects the buttons 36 of the adjustment slides 32 from being broken off the shafts 38 thereof. This same technique of providing an aperture 52 in a vent can be applied to other types of vents which incorporate different features than those shown in the present invention and it is to be understood that this aspect of the invention is equally applicable to other configurations of vents within the scope of the invention.

Although the automatic temperature responsive vent 10 has been discussed as being formed from plastic, it is to be understood that it could be made from other materials including metal or the like. In addition, configurations other than the rectangular configuration illustrated can be manufactured and square, oval, or round vents are also possible.

Although illustrative embodiments of the invention have been described in detail herein with reference to the accompanying drawings, it is to be understood that the invention is not limited to these precise embodiments, and that various changes and modifications may be effected therein without departing from the principles, scope or spirit of the invention.

It is obvious to those knowledgeable in the art, that the present design of the damper assembly, when installed in the ceiling of a room which vents into an attic (or space) that vents to the outside atmosphere is capable of responding to a sudden decrease in outside pressure by completely opening and equalizing the pressures therebetween.

Having thus set forth the nature of the invention, what is claimed is:

1. An energy saving system comprising:

(a) an automatic temperature responsive vent disposed in the ceiling of a room having a confined air space thereabove, said vent being provided with;
  (i) an air passage therethrough, and
  (ii) substantially planar flap means being movable from a closed position to an open position, said flap means being normally in said closed position; and (b) venting means disposed in one of the confining element means of said confined air space for venting said air into the outside atmosphere, one of said confining element means being adjacent to said automatic vent for receiving air flowing through said air passage, said venting means causing said air to exit said confined air space and open said automatic vent flap to rapidly equalize the air pressure between said room and said outside atmosphere when said outside atmosphere decreases.

2. An energy saving system according to claim 1, wherein said substantially planar flap means is pivotably affixed to a frame means disposed within said one confining element means.

3. An energy saving system according to claim 2 further including adjustment means for selectively preventing said flap means from reaching said closed position.

4. An energy saving system according to claim 1 further including substantially planar grille means disposed across said air passage and adjustment means for selectively preventing said flap means from reaching said closed position, said adjustment means being slidably affixed to said grille means.

5. An energy saving system according to claim 4 further including strengthening means for precluding the bending of said flap means when cooperating with said adjustment means.

6. An energy saving system according to claim 1 further including temperature responsive drive means disposed between a frame means disposed within said one confining element means and said flap means, said temperature responsive drive means expanding when actuated displacing said flap means relative to said frame means.

7. An energy saving system according to claim 6, wherein said temperature responsive drive means comprises a fluid containing bellows unit capable of expanding and contracting in response to temperature changes between predetermined limits and for generating a force upon expansion.

8. A system for responding to a sudden decrease in atmospheric pressure comprising:

(a) an energy saver automatic temperature responsive vent disposed in the ceiling of a room having a confined air space thereabove, said vent being provided with
  (i) an air passage therethrough, and
  (ii) substantially planar flap means being movable from a closed position to an open position, said flap means being normally in said closed position; and (b) venting means disposed in one of the confining element means of said confined air space for venting said air into the outside atmosphere, one of said confining element means being adjacent to said energy saver vent for receiving air flowing through said air passage, said venting means causing said air to exit said confined air space and open said energy saver vent flap solely by the pressure differential to rapidly equalize the air pressure between said room and said outside atmosphere when said outside atmosphere decreases.

9. An energy saving system comprising:

(a) an automatic temperature responsive vent disposed in the ceiling of a room having a confined air space thereabove, said vent being provided with;
  (i) an air passage therethrough,
  (ii) flap means being movable from a closed position to an open position, said flap means being normally in said closed position,
  (iii) grille means disposed across said air passage, and
  (iv) adjustment means slideably affixed to said grille means for selectively preventing said flap means from reaching said closed position; and (b) venting means disposed in one of the confining element means of said confined air space for venting said air into the outside atmosphere, one of said confining elements means being adjacent to said automatic vent for receiving air flowing through said air passage, said venting means causing said air to exit said confined air space and open said automatic vent flap to rapidly equalize the air pressure between said room and said outside atmosphere when said outside atmosphere decreases.

10. An energy saving system according to claim 9 further including strengthening means for precluding the bending of said flap means when cooperating with said adjustment means.

* * * * *